US005938373A

United States Patent [19]

Scudder

[11] Patent Number: 5,938,373

[45] Date of Patent: Aug. 17, 1999

[54] APPARATUS FOR PADDING A TRENCH INCLUDING CRUSHER FOR PULVERIZING EXCAVATED MATERIAL INTO GRADES OF MATERIAL

[76] Inventor: Erik D. Scudder, 150 E. 27th St., #6D, New York, N.Y. 10016

[21] Appl. No.: 08/504,685

[22] Filed: Jul. 20, 1995

[51] Int. Cl.[6] ..... E02F 5/22

[52] U.S. Cl. ..... 405/179; 37/142.5; 241/68; 241/101.74; 404/91

[58] Field of Search ..... 405/179, 174; 37/142.5; 404/91; 241/8, 68, 101.7

[56] References Cited

U.S. PATENT DOCUMENTS

| | | | |
|---|---|---|---|
| 2,814,387 | 11/1957 | McWilliams | 209/247 |
| 2,857,691 | 10/1958 | Curran | 172/33 |
| 3,442,381 | 5/1969 | Johnson | 209/326 |
| 3,622,089 | 11/1971 | Quinn | 241/81 X |
| 3,701,422 | 10/1972 | Downey | 209/241 |
| 3,860,291 | 1/1975 | Rauch et al. | 299/67 |
| 4,344,581 | 8/1982 | Redemann | 241/88.4 |
| 4,633,602 | 1/1987 | Layh et al. | 37/195 |
| 4,861,461 | 8/1989 | Utterback | 209/234 |
| 4,912,862 | 4/1990 | Bishop et al. | 37/142.5 |
| 4,948,299 | 8/1990 | Cronck, Jr. et al. | 405/179 |
| 4,961,542 | 10/1990 | Den Besten et al. | 241/101.74 |
| 5,120,433 | 6/1992 | Osadchuk | 209/235 |
| 5,259,699 | 11/1993 | Klamar | 405/179 |
| 5,430,962 | 7/1995 | Osadchuk | 405/179 X |
| 5,694,709 | 12/1997 | Cronk, Jr. et al. | 405/179 X |

FOREIGN PATENT DOCUMENTS 2152840 8/1985 United Kingdom .

*Primary Examiner*—Tamara L. Graysay
*Assistant Examiner*—Tara L. Mayo

[57] ABSTRACT

A method of padding a trench includes the steps of automatically gathering at least a portion of excavated material from the berm of a trench, auomatically pulverizing at least part of the gathered material to form a pulverized material, and automatically conveying the pulverized material to the trench. The gathered material can be separated into at least two grades of material, only one of the grades of material being pulverized to form the pulverized material, another of the grades of material being returned to the berm. The pulverized material can be collected for use as a sandblasting sand.

18 Claims, 3 Drawing Sheets

APPARATUS FOR PADDING A TRENCH INCLUDING CRUSHER FOR PULVERIZING EXCAVATED MATERIAL INTO GRADES OF MATERIAL

BACKGROUND OF THE INVENTION

Underground pipelines are a vital component of the petroleum industry, and new pipelines are continuously being constructed all around the world. In many cases, new pipleines are built in extreme climates or undeveloped regions ranging from the dense jungle to the barren desert. Because of the variety of challenges faced in the laying of pipleine and the need to ensure the continued integrity and operability of the pipeline, what would appear to be a simple operation of digging a trench and burying a pipeline is actually extremely complex.

As a pipleine is laid in a trench, care must be taken that the pipe's cathodic coating, which protects the pipe from rust and corrosion, is not damaged. Rocks and other objects normally found in the material excavated from the trench pose a threat to the integrity of this coating. Thus, it is necessary to surround the pipe with a 'padding' of fine material such as sand or sifted soil to protect the pipe before the trench is filled.

One method of supplying padding material to a pipeline construction site is to transport padding material to the construction site. This often requires the hauling of heavy materials over long distances and rough terrain, adding significantly to the costs of pipeline construction and demanding excessive expenditure of time and effort. Machines have been developed to manufacture some of the padding material on-site by processing the excavated material, known as spoil, to separate oversized materials from the fine materials and returning the fine materials to the trench as padding. See, for example, U.S. Pat. No. 4,948,299 to Cronk, Jr. et al. and U.S. Pat. No. 4,912,862 to Bishop et al.

In addition, to enhance or enable the proper welding of joints between adjacent sections of pipe in a pipeline, the surface of the pipe in a region about a joint is sandblasted prior to a welding operation. This process requires substantial amounts of sand, and there are many trench sites throughout the world, for example, in rocky locales or frozen tundra regions, where it is impossible to sift enough fine material for sandblasting the pipeline joint areas. At these sites, wet sand is hauled from beaches and dried prior to sandblasting. This is a laborious and expensive process, particularly where the pipeline construction sites are far from any beaches.

OBJECTS OF THE INVENTION

An object of the present invention is to provide an apparatus and an associated method for padding a trench.

A more particular object of the present invention is to provide such an apparatus and method that reduces or altogether eliminates the need to transport padding materials to a pipeline construction site.

A further object of the present invention is to provide such an apparatus and method that reduces or altogether eliminates the need to transport sandblasting sand to a pipeline construction site.

Yet another object of the present invention is to provide such an apparatus and method which can operate in conditions where sifting along is not sufficient or viable, where pulverization is necessary to provide the required amount of fill, owing to the nature of the material being processed.

A related object of the present invention is to provide such an apparatus and method that simplifies the process of pipeline construction, thereby reducing construction costs and construction time.

SUMMARY OF THE INVENTION

An apparatus for padding a trench in accordance with the present invention comprises a vehicle frame adapted for movement along the berm of the trench. An assembly is mounted to a front end of the vehicle frame for picking up excavated material from the berm. A pulverizing assembly is provided on the vehicle frame for pulverizing at least a portion of the excavated material to form a pulverized material, and the vehicle frame is further provided with an assembly for for transporting the excavated material from the picking assembly to pulverizing assembly. A conveying assembly is mounted on the vehicle frame for conveying the pulverized material to the trench.

According to one embodiment of the present invention, the vehicle frame is further provided with a collecting apparatus for collecting at least a portion of the pulverized material for use as a sandblasting sand.

Pursuant to an additional embodiment of the present invention, the pulverizing assembly comprises a separator for separating the excavated material into at least two grades of material, a crusher having an inlet and an outlet, and delivering components for delivering one of the grades of material from the separator to the inlet of the crusher.

The separator may have component parts for separating the excavated material into a coarse, a medium, and a fine grade of material, the grade delivered to the inlet of the crusher being the medium grade, further comprising an assembly for returning the coarse grade of material to the berm.

The conveying assembly may comprise a conveyor having a first end positioned below the outlet of the crusher for catching pulverized material produced by the crusher and a second end positionable over the trench.

Structural elements may be provided for directing the fine grade of material from the separator to the first end of the conveyor. Alternatively, an additional conveyor having a first end positioned for receiving the fine grade of material from the separator and a second end positionable over the trench, may be provided for conveying the fine grade of material to the trench.

According to a more specific embodiment of the present invention, the assembly for picking up excavated material comprises a spoil guide assembly pivotally mounted at a rear end thereof to the front end of the vehicle frame for collecting excavated material upon a forward movement of the vehicle frame.

The vehicle frame may be mounted on a track assembly. In this case, components are provided for driving the track assembly. Alternatively, the vehicle frame may be mounted on a tire assembly. In this case, components are provided for driving the tire assembly.

The separator may comprise a double screen assembly. In this case, the assembly for transporting the excavated material comprises an elevator having a first end at the assembly for picking up excavated material and a second end positioned above the screen assembly.

A method of padding a trench having a berm with excavated material therealong, in accordance with the present invention, comprises: (a) automatically gathering at least a portion of the excavated material from the berm; (b)

automatically pulverizing at least part of the gathered material to form a pulverized material; and (c) automatically conveying said pulverized material to the trench.

Pursuant to an additional feature of the present invention, the method further comprises automatically separating the gathered material into at least two grades of material, only one of the grades of material being pulverized to form the pulverized material.

The method may further comprise automatically returning another of the grades of material to the berm.

The gathering of the excavated material may comprise continuously gathering the excavated material along the berm of the trench, the conveying comprising continuously conveying the pulverized material to the trench along the bottom thereof.

The the step of separating may comprise automatically sifting the excavated material through a double screen assembly. In this case the step of sifting may comprise the step of automatically vibrating the double screen assembly.

A method of laying a pipeline in a trench having a berm with excavated material therealong, in accordance with the present invention, comprises: (a) gathering a portion of the excavated material from the berm; (b) pulverizing at least part of the gathered material to form a pulverized material; (c) conveying the pulverized material to the trench; and (d) laying a pipeline on the pulverized material in the trench.

According to a more specific embodiment of the present invention, the method further comprises the steps of: (e) gathering an additional portion of excavated material from the berm; (f) pulverizing at least part of the additional gathered material to form additional pulverized material; and (g) covering the pipeline with the additional pulverized material.

Pursuant to an even more specific embodiment of the present invention, the method further comprises the steps of: (h) gathering a further portion of excavated material from the berm; (i) pulverizing at least part of the further gathered material to form further pulverized material; and (j) after laying the pipeline and prior to covering the pipeline, sandblasting the pipeline using at least a portion of the further pulverized material as a sandblasting sand.

An apparatus and associated method in accordance with the present invention provide an efficient means for padding a pipeline while reducing or altogether eliminating the need to import padding materials to a pipeline site, thereby reducing or eliminating the cost and manpower needed to transport such materials. The present invention additionally provides for the production of sandblasting sand from materials at a pipeline site, thus reducing or eliminating the cost of transporting sandblasting sand to the pipeline site.

DETAILED DESCRIPTION

Figure 1:
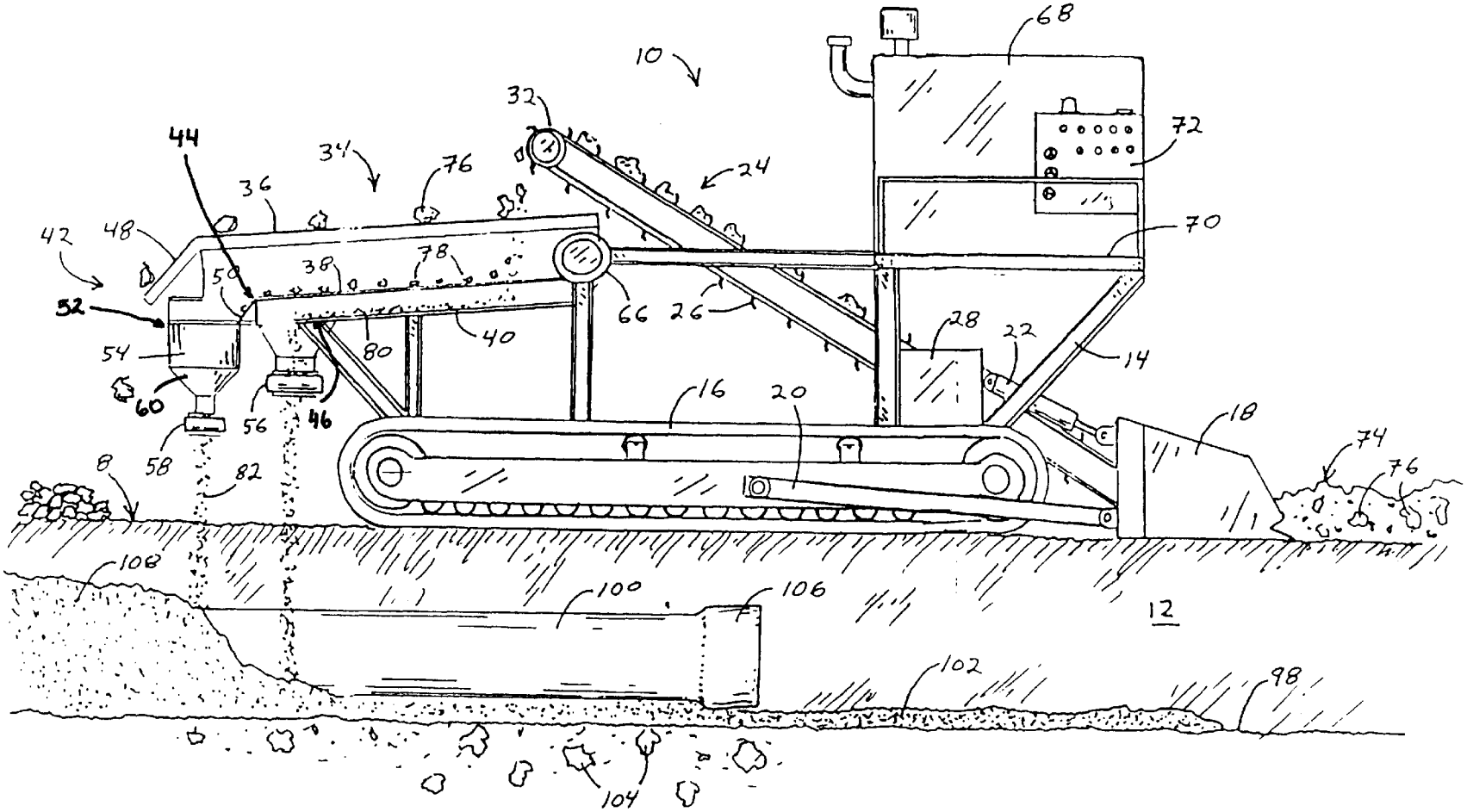
FIG. 1 is a schematic side-elevational view of a trench padding machine showing a stage in a padding operation.

A padding machine 10 for padding a trench 12 comprises a vehicle frame 14 mounted on tracks 16. A spoil guide assembly 18 is pivotally mounted to a front end of frame 14 by lever arms 20 and hydraulic pistons 22. A continuous-belt type elevator 24 having a plurality of paddles 26 is mounted to frame 14 by elevator mount 28. Elevator 24 has a front end 30 (FIG. 2) and a rear end 32. Front end 30 is positioned inside spoil guide assembly 18, and rear end 32 is positioned above a separator such as double screen assembly 34.

Screen assembly 34 comprises a coarse screen 36 above a fine screen 38 and a collecting plate 40 below fine screen 38. Coarse screen 36, fine screen 38, and collecting plate 40 are all inclined rearwardly toward their respective lower ends 42, 44, and 46. A chute 48 leads rearwardly off lower end 42 of coarse screen 36. An incline 50 leads off lower end 44 of fine screen 38 and into inlet 52 of crusher 54. A first conveyor 58 is mounted below an outlet 60 of crusher 54, and a second conveyor 56 is mounted below lower end 46 of collecting plate 40. In a preferred embodiment, conveyors 56 and 58 are of the continuous-belt type. Alternatively, one or both of conveyors 56 and 58 may be a simple gravity-driven chute. Distal ends 62 and 64 of conveyors 56 and 58, respectively, are positionable over trench 12. Conveyors 56 and 58 can be selectively extended to either side of padding machine 10 by a pivoting or sliding action in order to accomodate trenches on either side of padding machine 10.

Screen asembly 34 is mounted to frame 14 by vibrating separator mounts 66. Separator mounts 66 may vibrate screen assembly 34 by a rotating eccentric weight mechanism, an electromagnetic vibratimg mechanism, or any equivalent component for inducing mechanical vibrations.

An engine room 68 is mounted to vehicle frame 14, and a platform 70 allows an operator of padding machine 10 to access a control panel 72 to control the functions of engine room 68. As will be apparent to one skilled in the art of construction machinery, tracks 16, hydraulic piston 22, elevator 24, separator mounts 66, crusher 54, and conveyors 56 and 58 may be driven by engine room 68 and controlled by control panel 72 through hydraulic or mechanical linkages, or each may have its own drive and control mechanisms.

In a trench padding operation, padding machine 10 is positioned along a berm 8 of trench 12 in alignment with spoil 74 excavated from trench 12. Spoil 74 includes large particles 76 not suitable for inclusion in a padding material. As padding machine 10 moves forward, spoil 74 gathers in spoil guide assembly 18. The level of spoil guide assembly 18 relative to berm 8 can be adjusted by hydraulic pistons 22, such that, in a first pass, spoil guide assembly 18 removes only a top layer (not designated) of spoil 74, the lower portion of spoil 74 remaining for gathering by another pass of spoil guide assembly 18.

Spoil 74 gathered in spoil guide assembly 18 is picked up by elevator 24 at front end 30 thereof and carried to rear end 32 by paddles 26, where spoil 74 is dropped onto double screen assembly 34. A coarse grade of material consisting of large particles 76 does not pass through coarse screen 36, but instead, aided by the incline of coarse screen 36 and the vibration thereof by separator mount 66, large particles 76 descend over chute 48 to ground level 8.

A medium grade of material consisting of intermediate particles 78 and a fine grade of material consisting of small particles 80 pass through coarse screen 36 and fall to fine screen 38. Small particles 80 pass through fine screen 38 onto collecting plate 40 and, aided by gravity and the vibration of screen assembly 34, descend off lower end 46 and onto conveyor 56. Small particles 80 collect on conveyor 56 and are transported over distal end 62 thereof and into trench 12.

Intermediate particles 78 do not pass through fine screen 38 but instead descend over incline 50 and into inlet 52 of crusher 54, where intermediate particles 78 are pulverized into pulverized material 82. Pulverized material 82 collects on conveyor 58 and is transported over distal end 64 thereof and into trench 12.

The specific range of particle sizes in the coarse, medium, and fine grades of material will depend on the particular needs of a user of padding machine 10 and the environment in which machine 10 is employed. In general, the fine grade of material is selected to be a material suitable as a padding material with no further processing. The medium grade of material is selected to be a material with sizes of intermediate particles 78 too large for use as a padding material but small enough to be efficiently pulverized by crusher 54 into pulverized material 82, itself utilizable as a padding material. The coarse grade of material is selected to be a material with sizes of particles 76 too large to be efficiently processed by crusher 54. Alternatively, where a large amount of fine grade material is present in spoil 74, some particles having a size that is efficiently processible by the crusher may be included in the coarse grade of material in order to reduce the workload of crusher 54 to promote efficient operation of padding machine 10.

The range of particle sizes in the different grades of material is primarily determined by the sizes of openings (not designated) through screens 36 and 38, and screens 36 and 38 may be removably mounted in double screen assembly 34 to be exchangeable with screens having openings of different sizes.

It is to be noted that the separation of spoil 74 need not be performed by a double screen assembly, but may proceed using any of a number of processes known in the art. For example, a continuous belt as in U.S. Pat. No. 4,948,299 or a grizzly as in U.S. Pat. No. 3,701,422 may be used to effect the separation. In addition, it is not necesssary that spoil 74 be separated into three grades of material. For example, fine screen 38 could be replaced by a collecting plate such as plate 40, and fine particles 80 as well as intermediate particles 78 pass together into inlet 52 of crusher 54. Alternatively, spoil 74 can be separated into more than three grades of material for separate processing.

Figure 2:
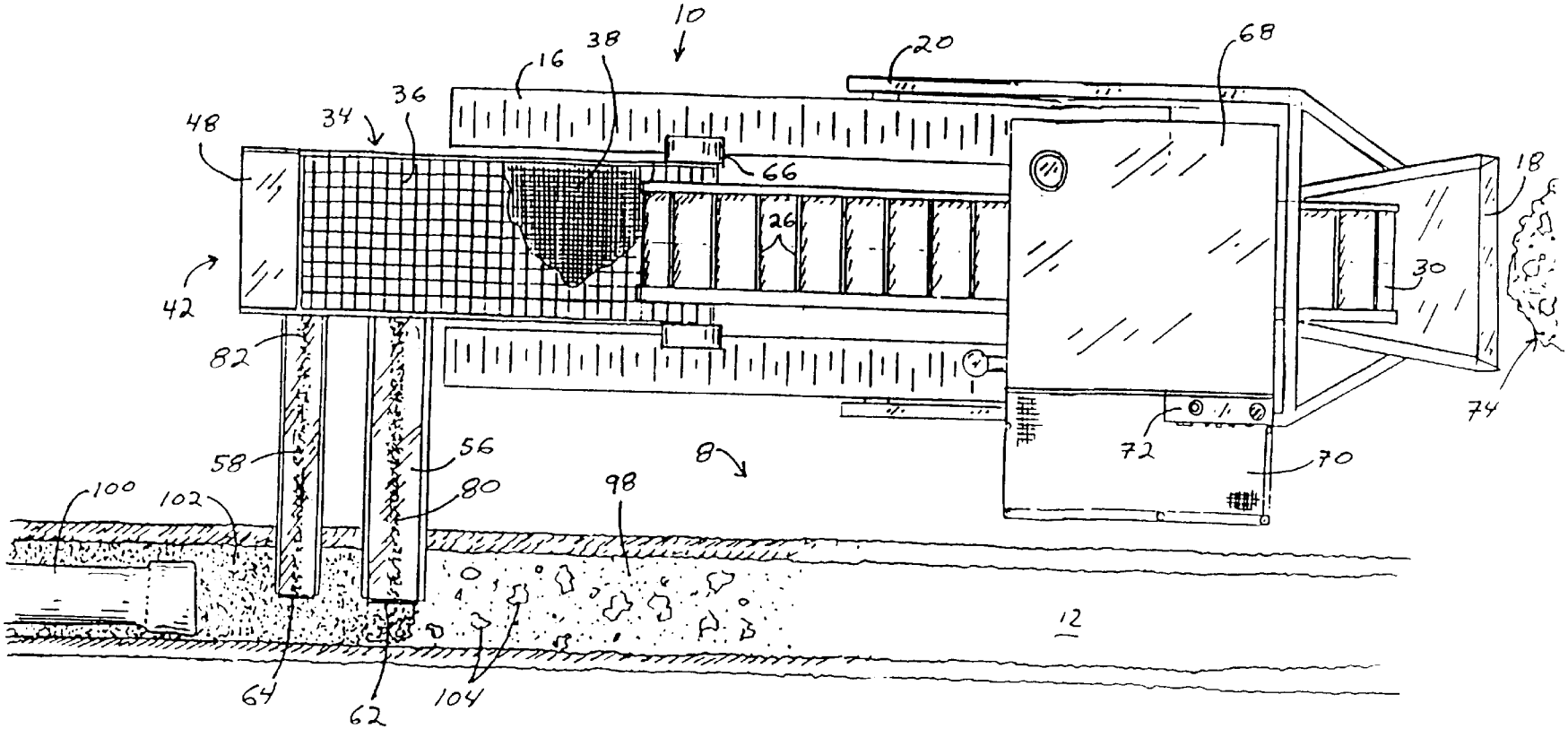
FIG. 2 is a schematic plan view of the machine of FIG. 1 showing another stage in a padding operation.
Figure 3:
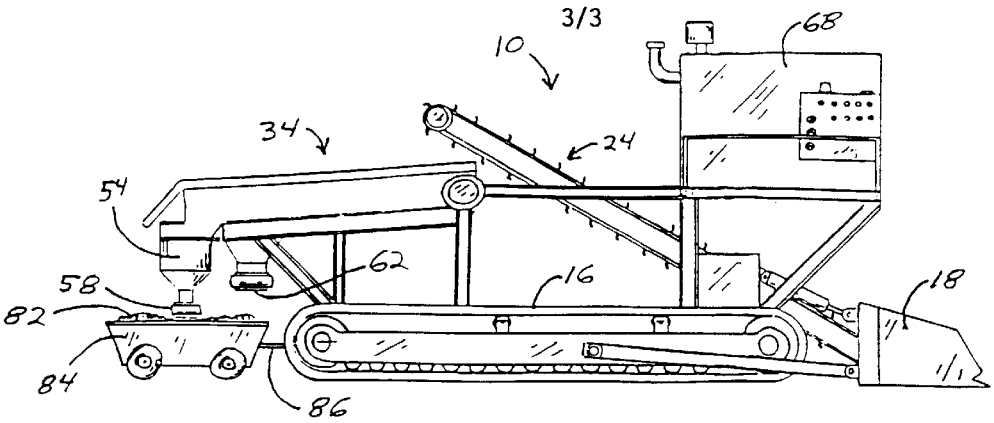
FIG. 3 is a schematic side-elevational view of a trench padding machine equipped with a cart for collecting pulverized material.

In an additional feature of the present invention illustrated in FIG. 3, a movable cart 84 is attached to padding machine 10 by a linkage 86. Cart 84 is positioned to collect pulverized material 82 from outlet 60 of crusher 54 for use as a sandblasting sand. Cart 84 may be positioned directly below outlet 60, or conveyor 58 may be used to transport pulverized material to an offset position of cart 84. For example, conveyor 56 may extend to the right of padding machine 10 to convey fine material 80 to trench 12 (FIG. 2) while distal end 64 extends to the left of machine 10 to fill cart 84 with pulverized material 82. In the case that cart 84 is used to collect pulverized material 82 for use as a sandblasting sand, crusher 54 is selected to produce a pulverized material 82 of a grade suitable for use as a sandblasting sand. Of course, an additional screen assembly (not shown) may be provided to reject particles of pulverized material 82 not suitable for use as a sandblasting sand.

Figure 4:
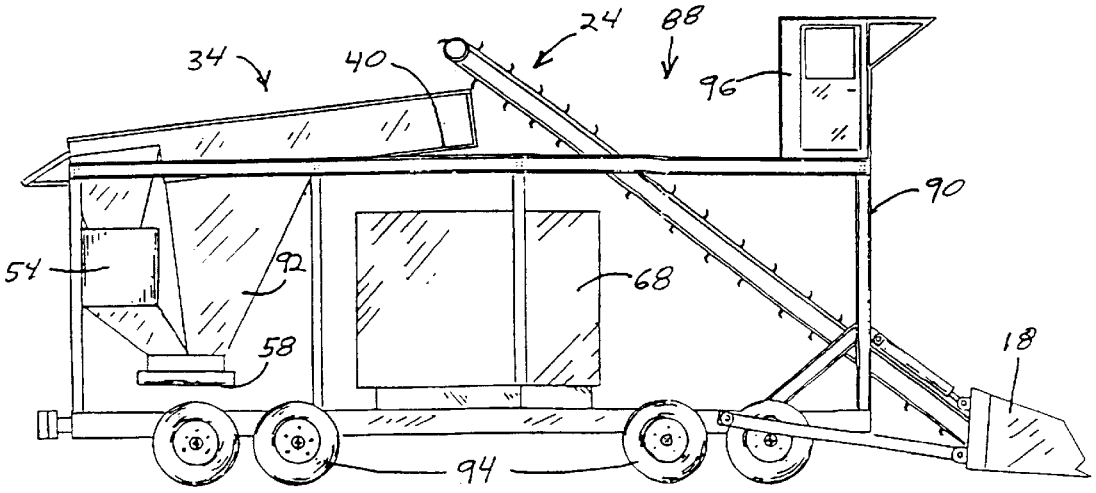
FIG. 4 is a schematic side-elevational view of another trench padding machine.

In an alternative embodiment of the present invention, (FIG. 4) a padding machine 88 comprises a vehicle frame 90 on which are mounted engine room 68, spoil guide assembly 18, elevator 24, double screen assembly 34, crusher 54, and conveyor 58. In addition, a guide 92 is mounted below double screen assembly 34 to direct fine particles 80 from collecting plate 40 to conveyor 58. Thus, only a single conveyor 58 is used to convey material to to trench 12.

Vehicle frame 90 is mounted on tire assembly 94, which is driven by engine room 68 through conventional mechanical or hydraulic linkages (not illustrated). A control cabin 96 is fixed to frame 90 to accomodate an operator of padding machine 88.

In a method of laying a pipeline in trench 12 having a berm 8 with spoil 74 therealong, padding machine 10 advances to gather a portion of spoil 74 in spoil guide assembly 18. Machine 10 processes spoil 74 and returns pulverized material 82 and fine particles 80 to a floor 98 of trench 12, forming a bottom layer 102 of padding (FIG. 2). A pipe 100 is then laid over padding layer 102. Padding layer 102 acts as a protective boundary between large particles 104 in trench floor 98 and pipe 100.

Padding machine 10 gathers and processes a further portion of spoil 74 and collects pulverized material 82 in a cart 84 (FIG. 3). Pipe joint 106 is welded following conventional pipeline construction techniques, and pulverized material 82 collected in cart 84 is used as a sandblasting sand to sandblast pipe joint 106.

Padding machine 10 advances to gather an additional portion of spoil 74 in spoil guide assembly 18. Machine 10 processes spoil 74 and returns pulverized material 82 and fine particles 80 to trench 12, forming a top layer 108 of padding (FIG. 1). Padding layer 108 covers and surrounds pipe 100.

Coarse particles 76 that have passed over chute 48 and collected on berm 8 may then be returned to trench 12 by any conventional process, such as the use of a bulldozer (not illustrated) to push coarse particles 76 into trench 12 on top of padding layer 108.

In a preferred embodiment, three separate padding machines 10 are employed. A first padding machine 10, as illustrated in FIG. 2, moves continuously along the berm of trench 12 laying bottom padding layer 102. A second padding machine 10, as illustrated in FIG. 1, moves continuously along the berm of trench 12 laying top padding layer 108. Pipe 100 is laid in trench 12 between the first machine 10 and the second machine 10. A third padding machine 10, as illustrated in FIG. 3, moves continuously along the berm of trench 12 collecting pulverized material 82 in cart 84 for use as a sandblasting sand. Chute 48 may be shaped to direct coarse particles 76 to one side of padding machine 12, so that on a subsequent pass of padding machine 10 coarse particles 76 are not again gathered by spoil guide assembly 12.

Of course, it is possible to employ only one or two padding machines 10, either by using a single machine 10 to perform more than one function, for example both the laying of bottom layer 102 and of top layer 108 in consecutive passes along the berm of trench 12, or by reverting to conventional means for carrying out one or more functions, such as importing sandblasting sand to the pipeline construction site.

Although the invention has been described in terms of particular embodiments and applications, one of ordinary skill in the art, in light of this teaching, can generate additional embodiments and modifications without departing from the spirit of or exceeding the scope of the claimed invention. For example, one or more vibrating sifting screens as described herein may be replaced with respective perforated rotating drums or trommels. Accordingly, it is to be understood that the drawings and descriptions herein are profferred by way of example and should not be construed to limit the scope thereof.

What is claimed is:

1. An apparatus for padding a trench having a berm with excavated material therealong, comprising:

(a) a vehicle frame adapted for movement along the berm;

(b) means at a front end of said vehicle frame for picking up excavated material from the berm (c) a crusher having an inlet and outlet, the crusher being mounted on the vehicle frame and arranged relative to the means for picking up and adapted to receive the excavated material, wherein the crusher is constructed and arranged to pulverize the received material into two grades of material, a first grade of pulverized material being of sufficient size for use as a padding material and a second grade of pulverized material being of which is sand blasting material (d) means on said vehicle frame for transporting the excavated material from said means for picking up to said crusher; and (e) means on said vehicle frame for conveying the first grade of pulverized material from the crusher to the trench and means for collecting the second grade of material from the crusher for use in sandblasting.

2. An apparatus for padding a trench having a berm with excavated material therealong, comprising:

(a) a vehicle frame adapted for movement along the berm;

(b) means at a front end of said vehicle frame for picking up excavated material from the berm (c) means for separating the excavated material into at least two grades of material, a first of said grades being fine grade material appropriate for use as padding material and a second of said grades being too large for use as padding material;

(d) a crusher having an inlet and outlet, the crusher being mounted on the vehicle frame and arranged relative to the means for picking up and adapted to receive the second grade of excavated material that is too large for use as padding material, wherein the crusher is constructed and arranged to pulverize the received material into third and fourth grades of material, the third grade being of sufficient size for use as a padding material and the fourth grade which is sandblasting material (e) means on said vehicle frame for transporting the excavated material from said means for picking up to said means for separating;

(f) means on said vehicle frame for conveying the first grade of material from the separating means to the trench; and (g) means on said vehicle frame for conveying the third grade of pulverized material from the crusher to the trench for use as a padding material and means for collecting the fourth grade of pulverized material from the crusher for use in sandblasting.

3. The apparatus of claim 2, wherein the separating means separates the excavated material into a fine, medium, and coarse grade material, the fine grade material being conveyed from the separating means to the trench by the conveying means and the medium grade material being received by the crusher, and wherein the apparatus further comprises a returning means which returns the coarse grade material to the berm.

4. The apparatus of claim 3, wherein the separating means comprises a double screen assembly having a first screen and a second screen, wherein the excavated material is transported by said transporting means to said first screen, said first screen separating the coarse grade material from the medium and fine grade material, and wherein the medium and fine grade material are then received by said second screen that separates the medium grade material from the fine grade material, the medium grade material then being received by the crusher and the fine grade material by said means for conveying to the trench.

5. The apparatus of claim 4, wherein said means for conveying the fine grade material to the trench comprises a conveyor having a first end positioned for receiving said fine grade of material from said means for separating and a second end positionable over the trench for conveying said fine grade material to the trench.

6. The apparatus of claim 5, wherein said means for picking up excavated material comprises a spoil guide assembly pivotally mounted at a rear end thereof to said front end of said vehicle frame for collecting excavated material upon a forward movement of said vehicle frame.

7. The apparatus of claim 6, wherein said vehicle frame is mounted on a track assembly, further comprising means for driving said track assembly.

8. The apparatus of claim 6, wherein said vehicle frame is mounted on a tire assembly, further comprising means for driving said tire assembly.

9. The apparatus of claim 6, wherein said means for transporting the excavated material comprises an elevator having a first end at said means for picking up excavated material and a second end positioned above said separating means.

10. An apparatus for padding a trench having a berm with excavated material therealong, comprising:

(a) a vehicle frame adapted for movement along the berm;

(b) means at a front end of said vehicle frame for picking up excavated material from the berm;

(c) means for separating the excavated material into at least two grades of material, a first of said grades being fine grade material appropriate for use as padding material and a second of said grades being too large for use as padding material;

(d) a crusher having an inlet and outlet, the crusher being mounted on the vehicle frame and arranged relative to the means for picking up and adapted to receive the second grade of excavated material that is too large for use as padding material, wherein the crusher pulverizes the material into sufficiently fine grade material which is sandblasting material, and (e) means on said vehicle frame for transporting the excavated material from said means for picking up to said means for separating; and (f) means on said vehicle frame for conveying the fine grade material from the separating means to the trench.

11. The apparatus of claim 10, further comprising means for collecting the pulverized material.

12. The apparatus of claim 10, wherein the separating means separates the excavated material into a fine, medium, and coarse grade material, the fine grade material being conveyed from the separating means to the trench by the conveying means and the medium grade material being received by the crusher, and wherein the apparatus further comprises a returning means which returns the coarse grade material to the berm.

13. The apparatus of claim 12, wherein the separating means comprises a double screen assembly having a first screen and a second screen, wherein the excavated material is transported by said transporting means to said first screen, said first screen separating the coarse grade material from the medium and fine grade material, and wherein the medium and fine grade material are then received by said second screen that separates the medium grade material from the fine grade material, the medium grade material then being received by the crusher and the fine grade material by said means for conveying to the trench.

14. The apparatus of claim 13, wherein said means for conveying the fine grade material to the trench comprises a conveyor having a first end positioned for receiving said fine grade of material from said means for separating and a second end positionable over the trench for conveying said fine grade material to the trench.

15. The apparatus of claim 13, wherein said means for picking up excavated material comprises a spoil guide assembly pivotally mounted at a rear end thereof to said front end of said vehicle frame for collecting excavated material upon a forward movement of said vehicle frame.

16. The apparatus of claim 13, wherein said vehicle frame is mounted on a track assembly, further comprising means for driving said track assembly.

17. The apparatus of claim 13, wherein said vehicle frame is mounted on a tire assembly, further comprising means for driving said tire assembly.

18. The apparatus of claim 13, wherein said means for transporting the excavated material comprises an elevator having a first end at said means for picking up excavated material and a second end positioned above said separating means.

* * * * *